US010194773B2

(12) United States Patent
Foreman

(10) Patent No.: US 10,194,773 B2
(45) Date of Patent: Feb. 5, 2019

(54) RETRACTING CURTAIN ASSEMBLY

(71) Applicant: Deborah Foreman, Olathe, KS (US)

(72) Inventor: Deborah Foreman, Olathe, KS (US)

( * ) Notice: Subject to any disclaimer, the term of this patent is extended or adjusted under 35 U.S.C. 154(b) by 0 days.

(21) Appl. No.: 15/590,410

(22) Filed: May 9, 2017

(65) Prior Publication Data

US 2018/0325327 A1 Nov. 15, 2018

(51) Int. Cl.
*A47K 3/36* (2006.01)
*A47K 3/38* (2006.01)

(52) U.S. Cl.
CPC ..... *A47K 3/362* (2013.01); *A47K 3/36* (2013.01); *A47K 3/38* (2013.01); *Y10S 160/90* (2013.01)

(58) Field of Classification Search
CPC ..... A47K 3/34
USPC ..... 4/557–558
See application file for complete search history.

(56) References Cited

U.S. PATENT DOCUMENTS

| | | | | |
|---|---|---|---|---|
| 4,958,112 | A | 9/1990 | Zerillo | |
| 5,732,419 | A * | 3/1998 | Feist | A47K 3/38 4/557 |
| D397,899 | S | 9/1998 | Velazquez | |
| 5,808,430 | A | 9/1998 | Ho | |
| 5,889,377 | A | 3/1999 | Mao | |
| 6,024,156 | A | 2/2000 | Chu | |
| 6,163,899 | A | 12/2000 | Leonard | |
| 6,412,124 | B1 * | 7/2002 | Anderson | A47K 3/362 160/199 |
| 2013/0112354 | A1 | 5/2013 | Hardison, III et al. | |

* cited by examiner

*Primary Examiner* — Lori Baker

(57) ABSTRACT

A retracting curtain assembly includes a housing that may extend between walls of a shower. A motion unit is provided and the motion unit positioned in the housing. A shower curtain is coupled to the motion unit. Thus, the motion unit urges the shower curtain between a closed position and an open position.

13 Claims, 4 Drawing Sheets

RETRACTING CURTAIN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to retracting devices and more particularly pertains to a new retracting device for selectively opening and closing a shower curtain.

BRIEF SUMMARY OF THE INVENTION

An embodiment of the disclosure meets the needs presented above by generally comprising a housing that may extend between walls of a shower. A motion unit is provided and the motion unit positioned in the housing. A shower curtain is coupled to the motion unit. Thus, the motion unit urges the shower curtain between a closed position and an open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
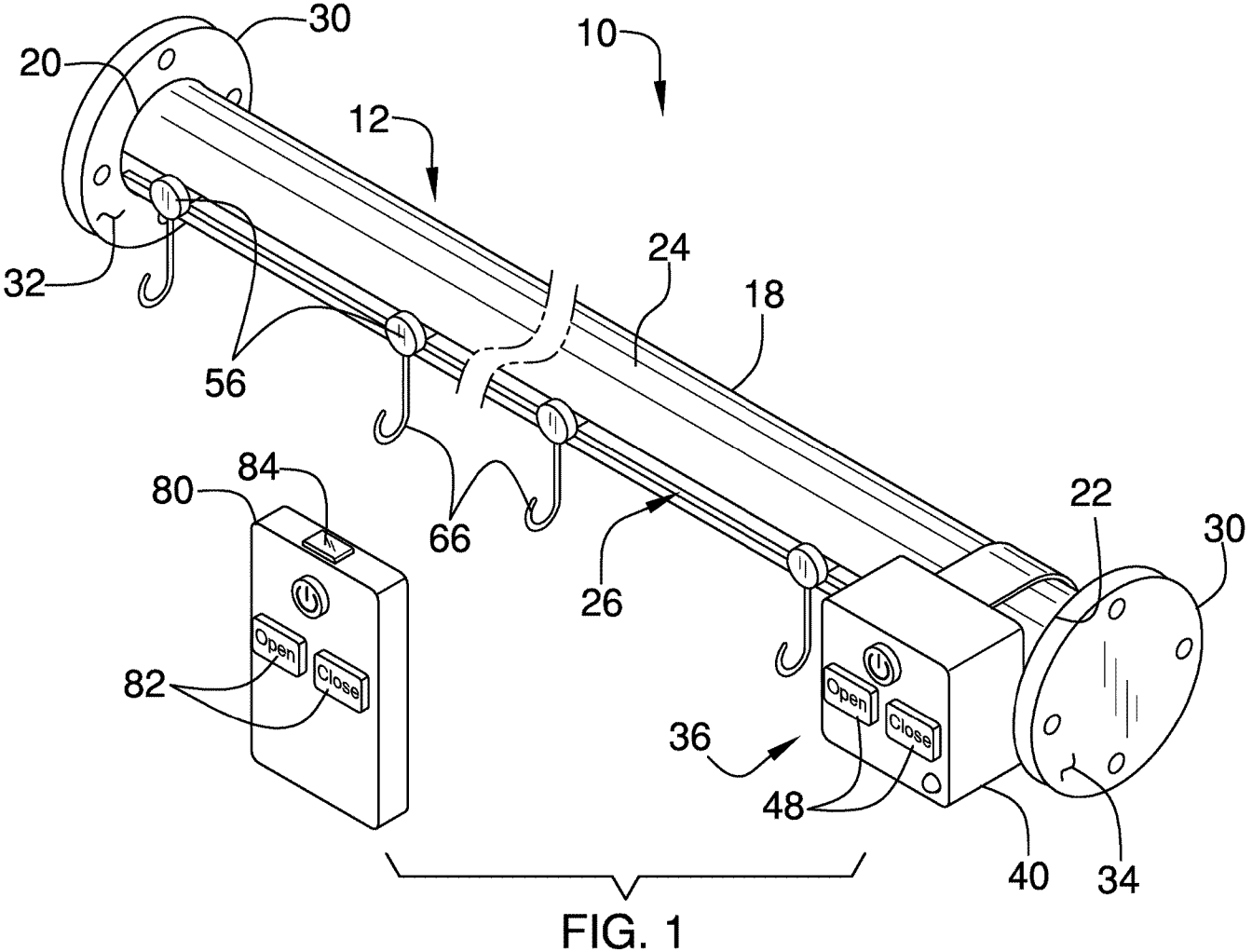
FIG. 1 is a perspective view of a retracting curtain assembly according to an embodiment of the disclosure.
Figure 2:
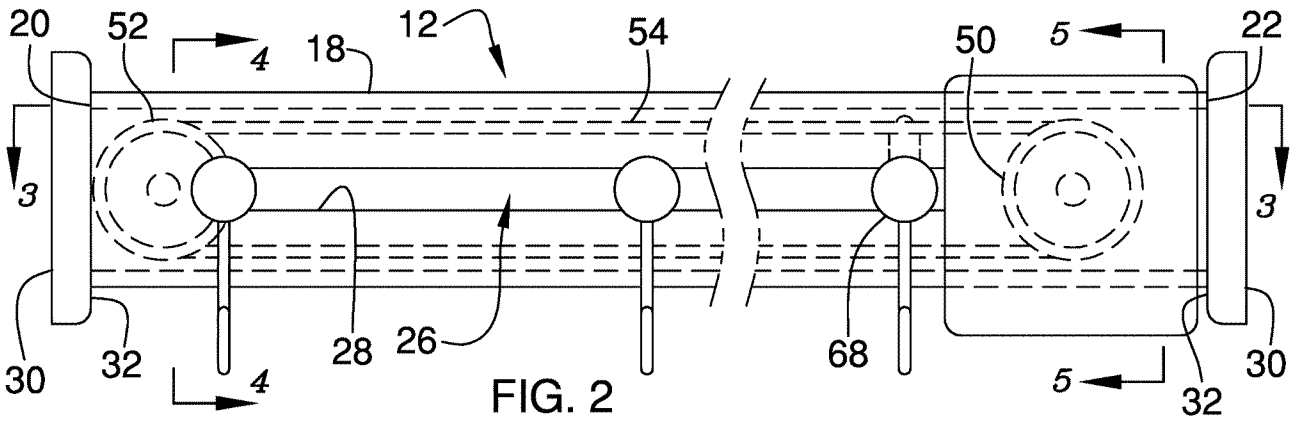
FIG. 2 is a front phantom view of an embodiment of the disclosure.
Figure 3:
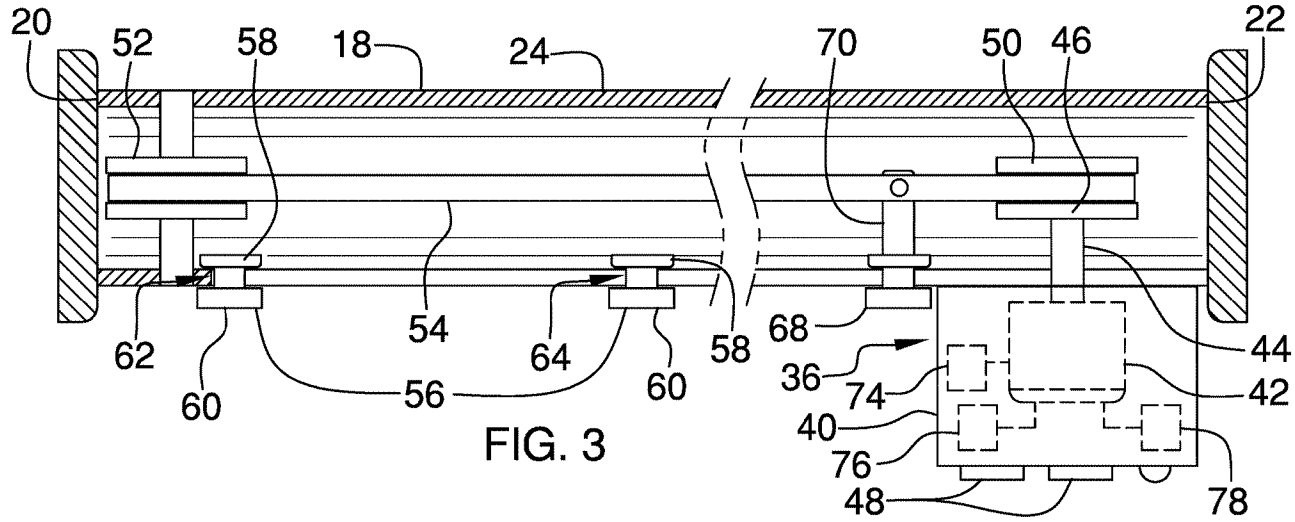
FIG. 3 is a cross sectional view taken along line 3-3 of FIG. 2 of an embodiment of the disclosure.
Figure 5:
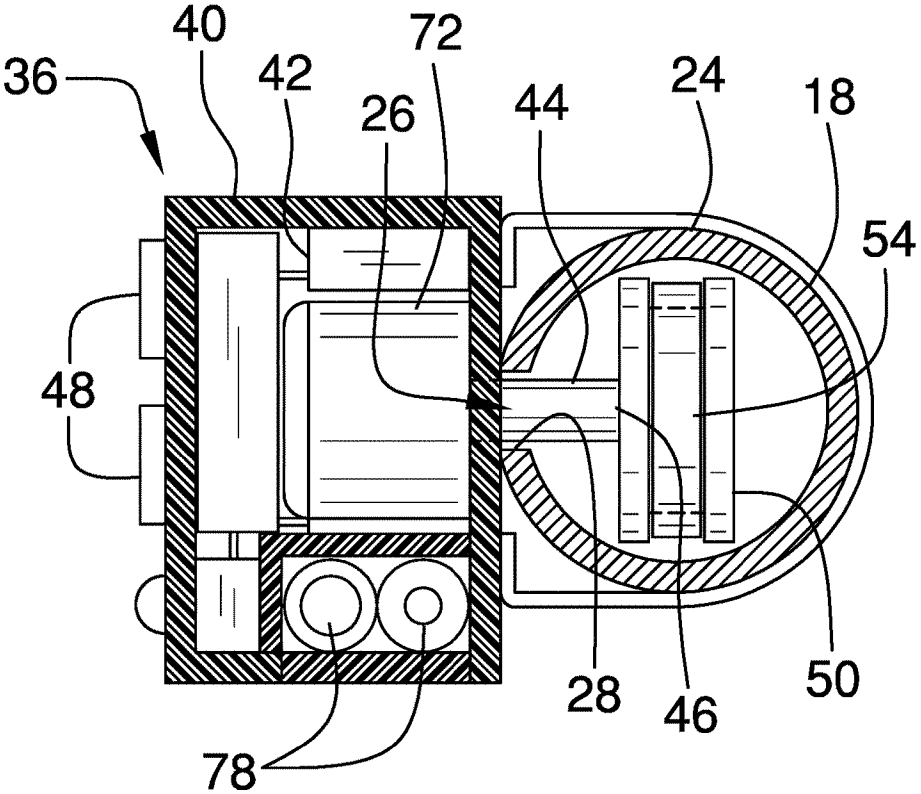
FIG. 5 is a cross sectional view taken along line 5-5 of FIG. 2 of an embodiment of the disclosure.
Figure 4:
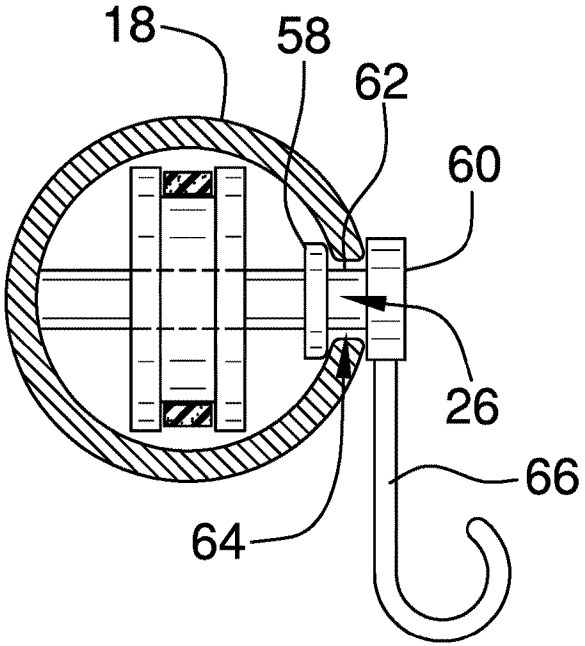
FIG. 4 is a cross sectional view taken along line 4-4 of FIG. 2 of an embodiment of the disclosure.
Figure 6:
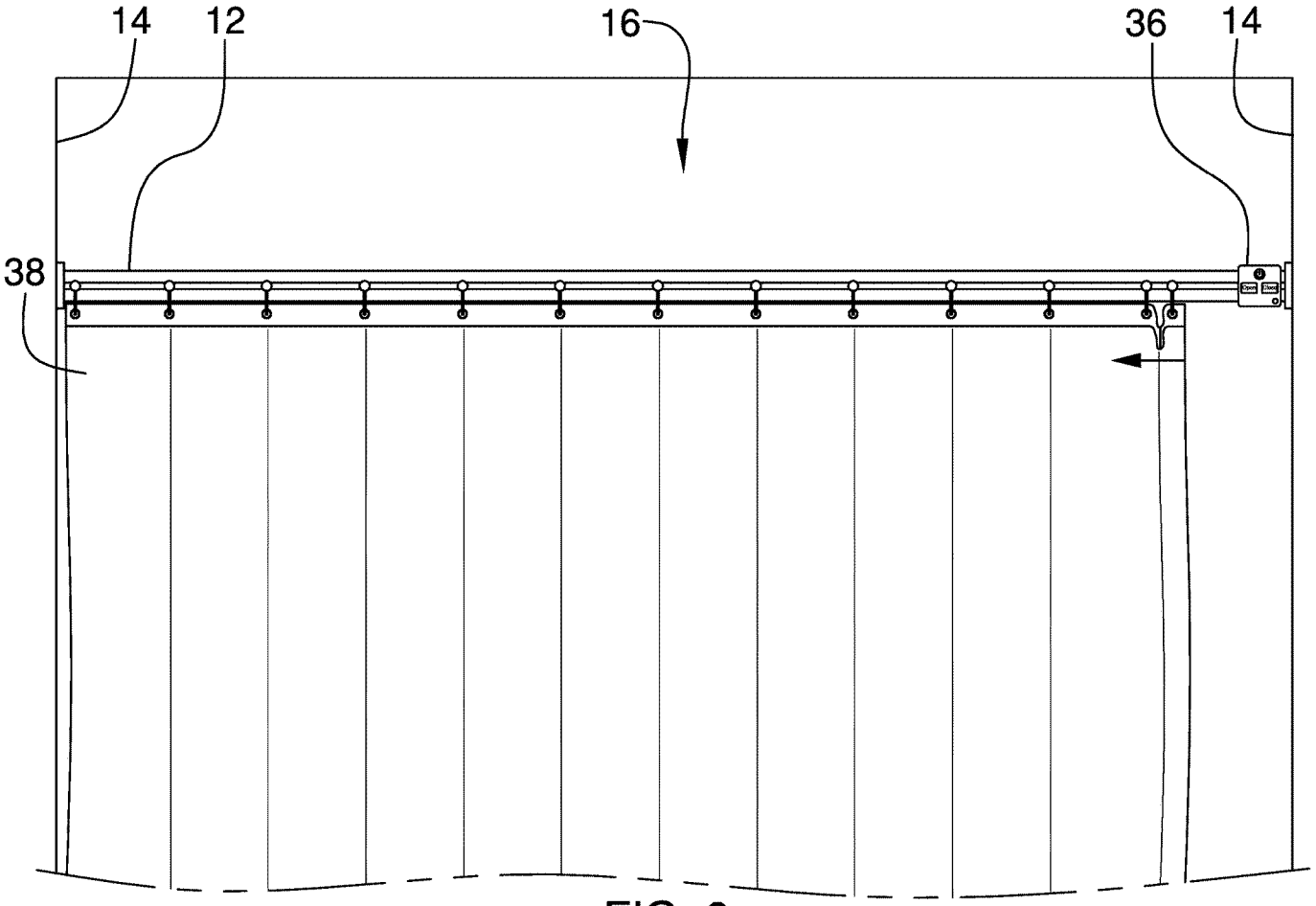
FIG. 6 is a perspective in-use view of an embodiment of the disclosure.

With reference now to the drawings, and in particular to FIGS. 1 through 6 thereof, a new retracting device embodying the principles and concepts of an embodiment of the disclosure and generally designated by the reference numeral 10 will be described.

As best illustrated in FIGS. 1 through 6, the retracting curtain assembly 10 generally comprises a housing 12. The housing 12 is positioned to extend between walls 14 of a shower 16. The shower 16 may be a bathing shower or the like. The housing 12 comprises a tube 18 that has a first end 20, a second end 22 and an outer wall 24. The outer wall 24 has a slot 26 extending into an interior of the tube 18. The slot 26 extends between the first end 20 and the second end 22, and the slot 26 has a bounding edge 28.

A pair of disks 30 is provided. Each of the disks 30 has a first surface 32 and a second surface 34. The first surface 32 of each disk 30 is coupled to an associated one of the first end 20 and the second end 22. The second surface 34 of each disk 30 frictionally engages an associated one of the walls 14 in the shower 16. Thus, the tube 18 extends horizontally between the walls 14 of the shower 16. Each of the disks 30 may be coupled to the associated wall 14 with a fastener or the like.

A motion unit 36 is provided. The motion unit 36 is positioned in the housing 12. A shower curtain 38 is coupled to the motion unit 36. The motion unit 36 urges the shower curtain 38 between a closed position and an open position.

The motion unit 36 comprises a box 40 that is coupled to the outer wall 24 of the tube 18. The box 40 is aligned with the second end 22. A motor 42 is positioned within the box 40. The motor 42 may be an electrical motor 42 or the like.

A shaft 44 is provided. The shaft 44 is coupled to the motor 42. The shaft 44 extends outwardly through the box 40 and into an interior of the tube 18. The shaft 44 has a distal end 46 with respect to the motor 42.

A plurality of buttons 48 is provided. Each of the buttons 48 is coupled to the box 40 and each of the buttons 48 may be manipulated. Each of the buttons 48 is electrically coupled to the motor 42. Thus, each of the buttons 48 controls operational parameters of the motor 42. The plurality of buttons 48 may include a power button, an open button and a close button.

A first pulley 50 is coupled to the distal end 46 of the shaft 44. The motor 42 rotates the first pulley 50 when the motor 42 is turned on. The first pulley 50 is positioned within the tube 18. A second pulley 52 is rotatably positioned within the tube 18. The second pulley 52 is spaced from the first pulley 50. A belt 54 is coupled around each of the first pulley 50 and the second pulley 52.

A plurality of couplers 56 is provided. Each of the couplers 56 is slidably positioned within the slot 26 in the tube 18. Thus, each of the couplers 56 is slidable between the first end 20 and the second end 22 of the tube 18. The shower curtain 38 is coupled to each of the couplers 56.

Each of the couplers 56 comprises a first head 58, a second head 60 and a stem 62 extending between the first head 58 and the second head 60. The first head 58 is spaced from the second head 60 to define a space 64 between the first head 58 and the second head 60. The stem 62 has a diameter that is less than a diameter of each of the first 58 and second 60 heads.

The bounding edge 28 of the slot 26 is positioned in the space 64. The first head 58 is positioned within the tube 18. The second head 60 is positioned outside of the tube 18. A hook 66 is coupled to and extends downwardly from the second head 60. The hook 66 engages the shower curtain 38.

The plurality of couplers 56 includes a first coupler 68. A rod 70 extends away from the first head 58 corresponding to the first coupler 68. The rod 70 is coupled to the belt 54. The belt 54 urges the first coupler 68 to travel along the slot 26 when the motor 42 is turned on. Thus, the first coupler 68 urges the shower curtain 38 between the closed position and the open position.

The box 40 includes a remote control circuit 72. The remote control circuit 72 is electrically coupled to the motor 42. The remote control circuit 72 includes a processor 74 and a receiver 76. The receiver 76 may be a radio frequency receiver 76 or the like. A power supply 78 is positioned within the box 40. The power supply 78 is electrically coupled to the motor 42. The power supply 78 comprises at least one battery.

A remote control 80 is provided. The remote control 80 includes a plurality of buttons 82 and a transmitter 84. Each of the buttons 82 on the remote control 80 is electrically coupled to the transmitter 84. The transmitter 84 is in electrical communication with the receiver 76. Thus, the remote control 80 controls operational parameters of the motion unit 36.

In use, the housing 12 is positioned to extend between the walls 14 of the shower 16. The shower curtain 38 is suspended from the hook 66 corresponding to each of the couplers 56. The remote control 80 is manipulated to selectively open and close the shower curtain 38. Thus, a user is inhibited from slipping and falling while manually opening and closing the shower curtain 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A retracting curtain assembly being configured to automatically extend and retract in a shower, said assembly comprising:

a housing being configured to extend between walls of a shower, said housing including a tube having a first end, a second end and an outer wall, said outer wall having a slot extending into an interior of said tube, said slot extending between said first end and said second end, said slot having a bounding edge;

a motion unit being positioned in said housing, said motion unit being configured to have a shower curtain coupled to said motion unit thereby facilitating said motion unit to urge the shower curtain between a closed position and an open position; and a pair of disks, each of said disks having a first surface and a second surface, said first surface of each disk being coupled to an associated one of said first end and said second end, said second surface of each disk being configured to frictionally engage an associated one of the walls in the shower.

2. A retracting curtain assembly being configured to automatically extend and retract in a shower, said assembly comprising:

a housing being configured to extend between walls of a shower, said housing including a tube having a first end, a second end and an outer wall, said outer wall having a slot extending into an interior of said tube, said slot extending between said first end and said second end, said slot having a bounding edge; and a motion unit being positioned in said housing, said motion unit being configured to have a shower curtain coupled to said motion unit thereby facilitating said motion unit to urge the shower curtain between a closed position and an open position, said motion unit comprises a box being coupled to said outer wall of said tube, said box being aligned with said second end.

3. The assembly according to claim 2, further comprising:

a motor being positioned within said box; and a shaft being coupled to said motor, said shaft extending outwardly through said box and into an interior of said tube, said shaft having a distal end with respect to said motor.

4. The assembly according to claim 3, further comprising a plurality of buttons, each of said buttons being coupled to said box wherein each of said buttons is configured to be manipulated, each of said buttons being electrically coupled to said motor such that each of said buttons controls operational parameters of said motor.

5. The assembly according to claim 3, further comprising a first pulley being coupled to said distal end of said shaft such that said motor rotates said first pulley when said motor is turned on, said first pulley being positioned within said tube.

6. The assembly according to claim 5, further comprising a second pulley being rotatably positioned within said tube, said second pulley being spaced from said first pulley.

7. The assembly according to claim 6, further comprising a belt being coupled around each of said first pulley and said second pulley.

8. The assembly according to claim 1, further comprising a plurality of couplers, each of said couplers being slidably positioned within said slot in said tube such that each of said couplers is slidable between said first end and said second end of said tube, each of said couplers being configured to have a shower curtain coupled thereto.

9. A retracting curtain assembly being configured to automatically extend and retract in a shower, said assembly comprising:

a housing being configured to extend between walls of a shower, said housing including a tube having a first end, a second end and an outer wall, said outer wall having a slot extending into an interior of said tube, said slot extending between said first end and said second end, said slot having a bounding edge;

a motion unit being positioned in said housing, said motion unit being configured to have a shower curtain coupled to said motion unit thereby facilitating said motion unit to urge the shower curtain between a closed position and an open position; and a plurality of couplers, each of said couplers being slidably positioned within said slot in said tube such that each of said couplers is slidable between said first end and said second end of said tube, each of said couplers being configured to have a shower curtain coupled thereto, wherein each of said couplers comprises:

a first head;

a second head; and a stem extending between said first head and said second head, said first head being spaced from said second head to define a space between said first head and said second head, said bounding edge of said slot being positioned in said space, said first head being positioned within said tube, said second head being positioned outside of said tube.

10. The assembly according to claim 9, further comprising a hook being coupled to and extending downwardly from said second head wherein said hook is configured to engage the shower curtain.

11. The assembly according to claim 9, wherein:

said motion unit includes:

a motor; and a belt; and said plurality of couplers includes a first coupler, said first coupler having a rod extending away from said first head corresponding to said first coupler, said rod being coupled to said belt such that said belt urges said first coupler to travel along said slot when said motor is turned on wherein said first coupler is configured to urge the shower curtain between the closed position and the open position.

12. The assembly according to claim 3, further comprising a power supply being positioned within said box, said power supply being electrically coupled to said motor, said power supply comprising at least one battery.

13. The assembly of claim 1, further comprising:

said motion unit comprising:

a box being coupled to said outer wall of said tube, said box being aligned with said second end, a motor being positioned within said box, a shaft being coupled to said motor, said shaft extending outwardly through said box and into an interior of said tube, said shaft having a distal end with respect to said motor, a plurality of buttons, each of said buttons being coupled to said box wherein each of said buttons is configured to be manipulated, each of said buttons being electrically coupled to said motor such that each of said buttons controls operational parameters of said motor, a first pulley being coupled to said distal end of said shaft such that said motor rotates said first pulley when said motor is turned on, said first pulley being positioned within said tube, a second pulley being rotatably positioned within said tube, said second pulley being spaced from said first pulley, a belt being coupled around each of said first pulley and said second pulley, a plurality of couplers, each of said couplers being slidably positioned within said slot in said tube such that each of said couplers is slidable between said first end and said second end of said tube, each of said couplers being configured to have a shower curtain coupled thereto, each of said couplers comprising:

a first head, a second head, a stem extending between said first head and said second head, said first head being spaced from said second head to define a space between said first head and said second head, said bounding edge of said slot being positioned in said space, said first head being positioned within said tube, said second head being positioned outside of said tube, and a hook being coupled to and extending downwardly from said second head wherein said hook is configured to engage the shower curtain, and said plurality of couplers including a first coupler, said first coupler having a rod extending away from said first head corresponding to said first coupler, said rod being coupled to said belt such that said belt urges said first coupler to travel along said slot when said motor is turned on wherein said first coupler is configured to urge the shower curtain between the closed position and the open position; and a power supply being positioned within said box, said power supply being electrically coupled to said motor, said power supply comprising at least one battery.

* * * * *